United States Patent [19]

Mullins

[11] 4,111,487

[45] Sep. 5, 1978

[54] UNDERGROUND MINING MACHINE WITH LONGWALL GUIDANCE SYSTEM

[75] Inventor: Rex Mullins, Burton upon Trent, England

[73] Assignee: Coal Industry (Patents) Limited, London, England

[21] Appl. No.: 839,528

[22] Filed: Oct. 5, 1977

Related U.S. Application Data

[63] Continuation of Ser. No. 677,225, Apr. 15, 1976.

[30] Foreign Application Priority Data

May 2, 1975 [GB] United Kingdom ..... 18451/75
Jan. 15, 1976 [GB] United Kingdom ..... 1573/76

[51] Int. Cl.[2] ..... E21C 35/12
[52] U.S. Cl. ..... 299/1

[58] Field of Search ..... 299/1

[56] References Cited

U.S. PATENT DOCUMENTS

| | | | |
|---|---|---|---|
| 3,362,750 | 1/1968 | Carnegie | 299/1 |
| 3,531,159 | 9/1970 | Schmidt | 299/1 |
| 3,578,807 | 5/1971 | Barrett | 299/1 |
| 3,727,332 | 11/1971 | Zimmer | 299/1 |
| 3,854,775 | 12/1974 | Anderson | 299/1 |

*Primary Examiner*—Ernest R. Purser
*Attorney, Agent, or Firm*—James C. Wray

[57] ABSTRACT

A signal derived from means, e.g. a gyroscope, mounted on the machine is used to guide a shearer drum along a straight path, the shearer being mounted on an underframe including two pivotally connected parts.

8 Claims, 3 Drawing Figures

UNDERGROUND MINING MACHINE WITH LONGWALL GUIDANCE SYSTEM

This is a continuation of application Ser. No. 677,225, filed Apr. 15, 1976.

This invention relates to underground mining equipment and in particular to such equipment which in use is adapted to traverse to and fro along a guide defining a path extending along a rock face.

It is known for such equipment including a coal mining machine to traverse to and fro along an armoured face conveyor defining a path extending along a longwall installation. In order to try to ensure the machine traverses along a desired path it is usual for an operator when advancing the conveyor towards the rock face in snake-like manner to try to align the advanced conveyor to define the desired path. However, it is difficult to determine the relative positions of conveyor sections along the whole length of the conveyor which is typically of the order of two hundred yards long. Thus, the operator has either to guess when he feels any one conveyor section is advanced sufficiently or else he advances the conveyor as far as possible towards the rock face. Consequently, the conveyor tends to be misaligned resulting in the defined path of the machine being different from the desired path.

It has been proposed to provide indicators arranged at intervals along the conveyor to measure and indicate the adjacent conveyor advance with respect to a base line. Unfortunately, such recorders require either complicated mechanisms to measure the conveyor advance or else anchored lengths of wire, cord or steel tape which are reeled out each time the adjacent conveyor is advanced and which require renewing at intervals. This renewal of the reels tends to be overlooked and thus, the indicators no longer give true indications of conveyor advance and alignment.

An object of the present invention is to provide improved underground mining equipment which tends to overcome the above problems.

According to the present invention, underground mining equipment for traversing to and fro along a defined path extending along a rock face comprises a first part adapted to be guided along the defined path, a second part at least a portion of which is relatively movable with respect to the first part in a direction transverse to the rock face and which is adapted to be fixedly attached to a cutter carrying unit, a mechanism for relatively moving the two parts, and means mounted on one of the parts and arranged to sense the defined path with respect to a preselected desired path, the means deriving a signal indicative of disparity between the defined and desired paths.

Preferably, the equipment comprises control means for receiving the derived signal and for controlling the mechanism such that the cutter carrying unit tends to follow the desired path.

The two parts may be pivotally connected to each other.

Conveniently, the mining equipment includes a mining machine associated with the second part and comprising the cutter carrying unit.

Preferably, the means is mounted on the machine adjacent to the pivotal connection between the two parts.

Advantageously, the mechanism comprises a piston and cylinder arrangement.

Preferably, the mechanism derives a signal indicative of the extent of movement of the piston and cylinder arrangement which signal is fed to the control means to provide a closed-loop system.

By way of example only, one embodiment of the present invention will be described with reference to the accompanying drawings, in which.

Figure 1:
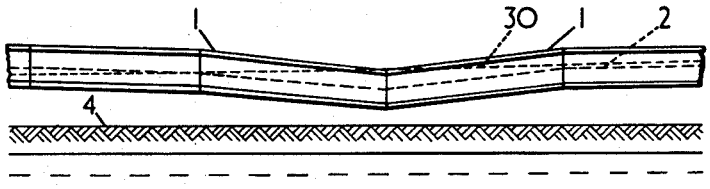
FIG. 1 is a diagrammatic plan of sections of an armoured face conveyor extending along a longwall face.

Referring to the drawings, FIG. 1 shows a plurality of armoured face conveyor sections 1 defining a path 2 for a mining machine 3 (see FIGS. 2 and 3) extending along a rock face 4 of a longwall installation in an underground coal seam. The conveyor provides a guide for the mining machine 3 which in use traverses to and fro along the conveyor winning coal from the rock face. Upon each coal winning traverse the conveyor is advanced in snake-like manner towards the newly exposed rock face.

It is clear from FIG. 1 that the conveyor defines a misaligned or crooked path 2 for the machine.

Figure 2:
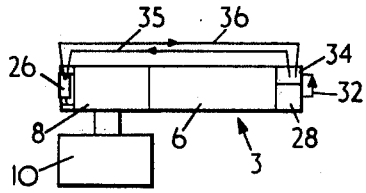
FIG. 2 is a diagrammatic plan of underground mining equipment including a mining machine and constructed in accordance with the present invention.
Figure 3:
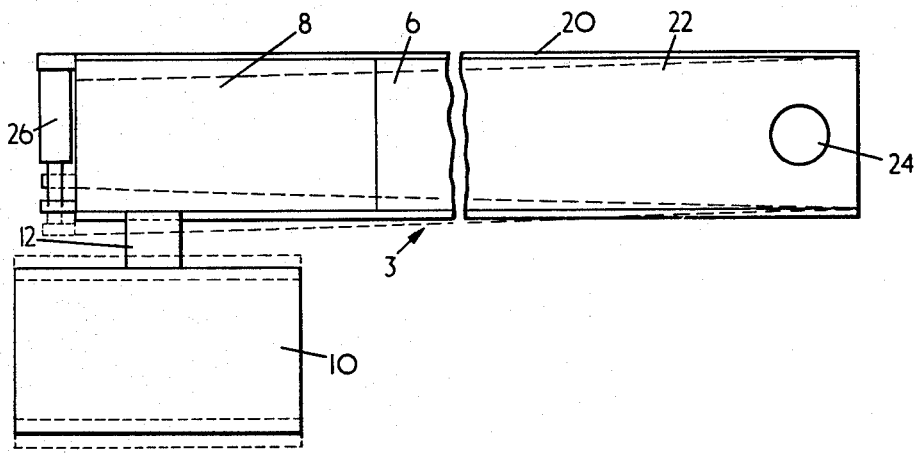
FIG. 3 is an incomplete diagrammatic plan of the underground mining equipment of FIG. 2 shown on an enlarged scale.

FIGS. 2 and 3 show the machine 3 to be a shearer type mining machine comprising a body 6 including a cutter carrying unit 8 for a rotary cutter drum 10 drivably mounted on a shaft 12 extending from the cutter carrying unit, and arranged to win a strip of coal from the rock face as the machine traverses along the conveyor. Coal won by the cutter drum 10 is loaded by helical loading vanes (not shown) provided on the cutter drum onto the conveyor.

The machine 3 is carried on an underframe (shown in detail in FIG. 3) comprising a first part in the form of a plate 20 guidably mounted on the conveyor by shoes (not shown) and a second art in the form of a plate 22 pivotally connected to the first part by a pivotal mounting 24. Relative movement of the two parts is controlled by a piston and cylinder arrangement 26 connected to the plates 20 and 22 at a location remote from the pivotal moutning 24. The extent of relative movement of the two parts is indicated by broken lines in FIG. 3.

The body 6 and cutter carrying unit 8 are mounted on the plate 22, the cutter carrying unit being mounted on a portion of the second part relatively movable with respect to first part.

Gyroscopic means 28 are mounted within the machine body 6 adjacent to the pivotal mounting such that as the machine traverses along the conveyor the gyroscopic means substantially follow the defined path 2. The gyroscopic means are arranged to sense the defined path with respect to a preselected desired path 30 (see FIG. 1) and to derive a signal indicative of the disparity between the defined path 2 and the desired path 30. The derived signal is fed along line 32 (see FIG. 2) to control means 34 mounted on the machine body 6 and arranged to activate the piston and cylinder arrangement by a signal fed along line 35 such that the cutter carrying unit 8 is urged to follow the preselected desired path 30. Thus, the cutter drum 10 tends to follow the desired path and the newly formed rock face 4 is substantially parallel to the desired path. A signal indicative of the movement of the piston and cylinder arrangement is fed back to the control means 34 along line 36 such that a closed loop control system is provided.

From the above description it will be seen that the present invention provides a relatively simple undergound mining equipment enabling a rock face to be formed along a preselected desired path.

In other embodiments of the invention the gyroscopic means are mounted on the said first part of the underframe.

The said means mounted on one of the parts may alternatively include an energy-emitting source target-table upon data arranged along the rock-face. In one embodiment the energy-emitting source comprises a light source and the data comprise retroreflectors sited at intervals along the face. Conveniently the retroreflectors may be located on roof supports positioned on the goaf side of the conveyor. In operation, the preselected desired path of the cutter unit is represented by a preselected reflective path of the light beam emitted from the source and reflected by the retroreflector. Any deviation of the reflected light beam from the preselected path indicates a disparity between the defined and desired paths of the cutter unit. Such deviation is conveniently detected optically by detection means, e.g. photo diodes, included in the said means and mounted on the machine. A signal indicative of the disparity is derived by the detection means for receipt by the said control means.

What is claimed is:

1. Underground mining equipment for traversing to and fro along a horizontal defined path extending along a generally vertical rock face, comprising a first part adapted to be guided along the defined path, a second part at least a portion of which is relatively movable with respect to the first part in a direction transverse to the rock face, a cutter carrying unit fixedly attached to the second part and a rotary cutter drum rotatably mounted on the second part and means mounted on the second part and connected to the drum for rotating the drum, mechanism connected to the first and second parts for relatively moving the two parts horizontally in either direction for moving the cutter unit and second part along a preselected desired path while the first part moves along the defined path, and sensing means deriving a signal indicative of disparity between the defined and desired paths.

2. Equipment as claimed in claim 1, comprising control means connected to the sensing means for receiving the derived signal and connected to the mechanism for controlling the mechanism such that the cutter carrying unit tends to follow the desired path.

3. A mineral mining machine for traversing to and fro along a horizontal defined path extending along a generally vertical rock face, comprising a first part, means connected to the first part for moving the first part along the defined path, a second part movably connected to the first part, means connected to the first and second parts for relatively moving the second part with respect to the first part in a horizontal direction transverse to the rock face to a cutter carrying unit fixedly attached to the second part and a rotary cutter drum rotatably mounted on the second part and means mounted on the second part and connected to the drum for rotating the drum, mechanism for relatively moving the two parts, and means mounted on one of the parts and arranged to sense the defined path independent of the rock face with respect to a preselected desired path, the means deriving a signal indicative of disparity between the defined and desired paths.

4. A machine as claimed in claim 3, comprising control means for receiving the derived signal and for controlling the mechanism such that the cutter carrying unit tends to follow the desired path.

5. A machine as claimed in claim 4, in which the two parts are pivotally connected to each other.

6. A machine as claimed in claim 5, in which the means is mounted on the machine adjacent to the pivotal connection between the two parts.

7. A machine as claimed in claim 6, in which the mechanism comprises a piston and cylinder arrangement.

8. A machine as claimed in claim 7, in which the mechanism derives a signal indicative of the extent of movement of the piston and cylinder arrangement which signal is fed to the control means to provide a closed-loop system.

* * * * *